US006132528A

United States Patent [19]

Brauer et al.

[11] Patent Number: 6,132,528

[45] **Date of Patent: *Oct. 17, 2000**

[54] IRON MODIFIED TIN BRASS

[75] Inventors: Dennis R. Brauer, Brighton, Ill.; John F. Breedis, Trumbull, Conn.; Ronald N. Caron, Branford, Conn.; Carl Deppisch, Hamden, Conn.; W. Gary Watson; Richard P. Vierod, both of Cheshire, Conn.

[73] Assignee: Olin Corporation, East Alton, Ill.

[ * ] Notice: This patent is subject to a terminal disclaimer.

[21] Appl. No.: 09/103,681

[22] Filed: Jun. 23, 1998

Related U.S. Application Data

[63] Continuation-in-part of application No. 08/844,478, Apr. 18, 1997, Pat. No. 5,853,505.

[51] Int. Cl.[7] ..... C22C 9/04

[52] U.S. Cl. ..... 148/434; 420/477

[58] Field of Search ..... 148/434; 420/477

[56] References Cited

U.S. PATENT DOCUMENTS

| | | |
|---|---|---|
| 130,702 | 8/1872 | Dick . |
| 632,233 | 9/1899 | Bull . |
| 1,716,833 | 6/1929 | Rich . |
| 1,988,938 | 1/1935 | Corson . |
| 2,112,373 | 3/1938 | Lytle . |
| 2,128,954 | 9/1938 | Montgomery . |
| 2,128,955 | 9/1938 | Montgomery . |
| 2,210,670 | 8/1940 | Kelly . |
| 3,039,867 | 6/1962 | McLain . |
| 3,639,119 | 2/1972 | McLain . |
| 3,698,965 | 10/1972 | Ence . |
| 3,930,894 | 1/1976 | Shapiro et al. . |
| 3,951,651 | 4/1976 | Mehrabian et al. . |
| 3,954,455 | 5/1976 | Flemings et al. . |
| 4,012,240 | 3/1977 | Hinrichsen et al. . |
| 4,073,667 | 2/1978 | Caron et al. . |
| 4,106,956 | 8/1978 | Bercovici . |
| 4,116,686 | 9/1978 | Mravic et al. . |
| 4,229,210 | 10/1980 | Winter et al. . |

(List continued on next page.)

FOREIGN PATENT DOCUMENTS

| | | |
|---|---|---|
| 57-68061 | 4/1982 | Japan . |
| 61-243141 | 10/1986 | Japan . |
| 63-266049 | 11/1988 | Japan . |
| 02107730 | 4/1990 | Japan . |
| 02163331 | 6/1990 | Japan . |
| 03111529 | 5/1991 | Japan . |
| 03162536 | 7/1991 | Japan . |
| 03193849 | 8/1991 | Japan . |
| 3291342 | 12/1991 | Japan . |
| 3291343 | 12/1991 | Japan . |
| 04231443 | 8/1992 | Japan . |
| 4-231430 | 8/1992 | Japan . |
| 05009619 | 1/1993 | Japan . |
| 05214465 | 8/1993 | Japan . |
| 07054079 | 5/1995 | Japan . |
| 07062472 | 7/1995 | Japan . |
| WO 8701138 | 1/1987 | WIPO . |

OTHER PUBLICATIONS

Metallurgical Reviews, vol. 11, Bristow, J.S., Ed.(1990) pp. 47–60.

*ASM Hoandbook®Formerly Tenth Edition*, vol. 2, "Properties and Selection: Nonferrous Alloys and Special–Purpose Materials" (Jan. 1992) pp. 260–263 and p. 295.

*Primary Examiner*—Sikyin Ip

*Attorney, Agent, or Firm*—Gregory S. Rosenblatt; Wiggin & Dana

[57] ABSTRACT

There is provided a tin brass alloy having a grain structure that is refined by the addition of controlled amounts of both zinc and iron. Direct chill cast alloys containing from 1% to 4%, by weight of tin, from 0.8% to 4% of iron, from an amount effective to enhance iron initiated grain refinement to 35% of zinc and the remainder copper and inevitable impurities are readily hot worked. The zinc addition further increases the strength of the alloy and improves the bend formability in the "good way", perpendicular to the longitudinal axis of a rolled strip. Certain of the grain refined brass alloys are useful as semisolid forming feedstock.

21 Claims, 13 Drawing Sheets

U.S. PATENT DOCUMENTS 4,249,941 2/1981 Futatsuka et al. .
4,415,374 11/1983 Young et al. .
4,434,837 3/1984 Winter et al. .
4,486,250 12/1984 Nakajima .
4,494,461 1/1985 Pryor et al. .
4,569,702 2/1986 Ashok et al. .
4,585,494 4/1986 Ashok et al. .
4,586,967 5/1986 Shapiro et al. .
4,627,960 12/1986 Nakajima et al. .
4,642,146 2/1987 Ashok et al. .
4,644,674 2/1987 Burrows et al. .
4,666,667 5/1987 Kamio et al. .
4,822,562 4/1989 Miyafuji et al. .
4,935,076 6/1990 Yamaguchi et al. .
5,370,840 12/1994 Caron et al. .
5,487,867 1/1996 Singh ..... 420/471
5,853,505 12/1998 Brauer et al. ..... 148/433
5,865,910 2/1999 Bhargawa ..... 148/433

IRON MODIFIED TIN BRASS

CROSS REFERENCE TO RELATED APPLICATION

This patent application is a continuation in part of United States patent application Ser. No. 08/844,478 entitled "Iron Modified Tin Brass" by Brauer et al. that was filed on Apr. 18, 1997 and is now U.S. Pat. No. 5,853,505. That patent is incorporated by reference in its entirety herein.

BACKGROUND OF THE INVENTION

1. Field of the Invention

This invention relates to copper alloys having high strength, good formability and relatively high electrical conductivity. More particularly, the yield strength of a tin brass is increased through a controlled addition of iron.

2. Description of Related Art

Throughout this patent application, all percentages are given in weight percent unless otherwise specified.

Commercial tin brasses are copper alloys containing from 0.35% to 4% tin, up to 0.35% phosphorous, from 49% to 96% copper and the balance zinc. The alloys are designated by the Copper Development Association (CDA) as copper alloys C40400 through C49080.

One commercial tin brass is a copper alloy designated as C42500. The alloy has the composition 87%–90% of copper, 1.5%–3.0% of tin, a maximum of 0.05% of iron, a maximum of 0.35% phosphorous and the balance zinc. Among the products formed from this alloy are electrical switch springs, terminals, connectors, fuse clips, pen clips and weather stripping.

The *ASM Handbook* specifies copper alloy C42500 as having a nominal electrical conductivity of 28% IACS (International Annealed Copper Standard where "pure" copper is assigned a conductivity value of 100% IACS at 20° C.) and a yield strength, dependent on temper, of between 45 ksi and 92 ksi. The alloy is suitable for many electrical connector applications, however the yield strength is lower than desired.

It is known to increase the yield strength of certain copper alloys through controlled additions of iron. For example, commonly owned U.S. patent application Ser. No. 08/591,065 entitled "Iron Modified Phosphor-Bronze" by Caron et al. that was filed on Feb. 9, 1996 and is now U.S. Pat. No. 5,882,442, discloses the addition of 1.65%–4.0% of iron to phosphor bronze. The Caron et al. alloy has an electrical conductivity in excess of 30% IACS and an ultimate tensile strength in excess of 95 ksi.

U.S. Pat. No. 5,882,442 is incorporated by reference in its entirety herein.

Japanese patent application number 57-68061 by Furukawa Metal Industries Company, Ltd. discloses a copper alloy containing 0.5%–3.0%, each, of zinc, tin and iron. It is disclosed that iron increases the strength and heat resistance of the alloy.

Japanese patent application number 61-243141 by Japan Engineering Corp. discloses a copper alloy containing 1%–25% of zinc and 0.1%–5% each of nickel, tin and iron. The alloy further contains 0.001%–1% of boron and 0.01%–5% or either manganese or silicon. The boron and manganese or silicon are disclosed as providing precipitation hardening capability to the alloy.

While the benefit of an iron addition to phosphor-bronze is known, iron causes problems for the alloy. The electrical conductivity of the alloy is degraded and processing of the alloy is impacted by the formation of stringers. Stringers form when the alloy contains more than a critical iron content, which content is dependent on the alloy composition. The stringers originate when properitectic iron particles precipitate from liquid prior to solidification and elongate during mechanical deformation. Stringers are detrimental because they affect the surface appearance of the alloy and can degrade the formability characteristics.

In high copper (in excess of 85% Cu) tin brass, the maximum permissible iron content, as an impurity, is typically 0.05%. This is because iron is known to reduce electrical conductivity and, through the formation of stringers, deteriorate the bend properties.

Copper alloys containing iron and tin within certain compositional ranges exhibit non-dendritic, as-cast, grain structures. For example, U.S. Pat. No. 4,116,686 entitled, "Copper Base Alloys Possessing Improved Processability," by Mravic et al. discloses a copper alloy containing 4.0%–11.0% of tin, 0.01%–0.3% of phosphorous, 1.0%–5.0% of iron and 10 the balance copper. The Mravic et al. alloy may further include small but effective amounts of many specified alloy additions, including zinc. The as-cast alloy is disclosed as possessing a substantially non-dendritic grain structure in the cast condition which contributes to improved processability. The Mravic et al. patent is incorporated by reference in its entirety herein.

Certain non-dendritic alloys have utility as semisolid forming stock. A billet useful as semisolid forming stock has a highly segregated structure consisting of a primary non-dendritic phase surrounded by a segregated phase that melts at a lower temperature than the primary phase. The billet is heated to a temperature effective to melt the lower melting temperature phase, but not the primary phase. If the primary phase is dendritic, the solid primary phase is mechanically locked and no benefit is achieved. If however, the solid primary phase is non-dendritic, then a metal slurry is formed that can be caused to flow under shear stress conditions.

Flowing the slurry into a mold provides a number of advantages over pouring liquid metal of the same composition into the mold. The slurry flows at a lower temperature than required to completely melt an alloy of similar composition. The die is therefore exposed to lower temperatures and die life is increased. The slurry is extruded into a mold with less turbulence than typically results when molten metal is poured causing less air to be entrapped in the casting and therefore, the formed product has less porosity.

Typically, semisolid forming stock is produced by cooling molten metal while the metal is agitated, either mechanically or electromagentically, to fracture dendrites as they form producing a solid phase with substantially spherical degenerate dendrites. U.S. Pat. No. 4,642,146, entitled "Alpha Copper Base Alloy Adapted to be Formed as a Semi-Solid Metal Slurry," by Ashok et al., discloses an alloy useful as semisolid forming stock without stirring or other agitation during casting. The alloy composition is 3%–6% of nickel, 5%–15% of zinc, 2%–4.25% of aluminum, 0.25%–1.2% of silicon, 3%–5% of iron and the balance is copper. A minimum of 3% iron is disclosed for preventing columnar dendrites. The Ashok et al. patent is incorporated by reference in its entirety herein.

It is necessary that the lower melting temperature phase be liquid and the primary, higher melting temperature, phase be solid over a relatively wide temperature range ("semisolid forming processing range"). A wide semisolid forming processing range makes process control easier. For example, an addition of iron to copper alloy C260 (nominal composition of 70% copper and 30% zinc) produced an alloy with only a 5° C. semisolid forming processing range. The alloy exhibited an abrupt transition from initial homogeneous flow (of the slurry) to liquid separation (where molten metal is ejected from the material).

There exists, therefore, a need for an iron modified tin brass alloy that does not suffer from the stated disadvantages of reduced electrical conductivity and stringer formation. There also exists a need for a copper alloy useful as semisolid forming stock that has a broad processing range.

SUMMARY OF THE INVENTION

Accordingly, it is a first object of the invention to provide a tin brass alloy having increased strength. It is a second object of the invention to provide a copper alloy that is useful as semisolid forming stock.

It is a feature of the invention that the increased strength is achieved by an addition of controlled amounts of a combination of iron and zinc. It is another feature of the invention that by processing the alloy according to a specified sequence of steps, a fine microstructure is retained in the wrought alloy.

It is another feature of the invention that the addition of controlled amounts of iron and tin to brass can produce an alloy suitable as semisolid forming stock.

Among the advantages of the alloy of the invention are that the yield strength is increased without a degradation in electrical conductivity. The microstructure of a refined as-cast alloy, grain size less than 100 microns, and a wrought alloy, grain size of about 5–20 microns, is fine grain. Still another advantage is that the electrical conductivity is about equal to that of copper alloy C42500 with a significant increase in yield strength.

Among the advantages of the alloy of the invention as semisolid forming stock are that the alloy has a wide semisolid forming processing range. The alloy retains a yellow color and resists corrosion making it particularly useful for decorative parts, such as plumbing fixtures, builder's hardware and sporting goods.

In accordance with a first embodiment of the invention, there is provided a copper alloy. This alloy consists essentially of from 1% to 4% by weight of tin, from 0.8% to 4.0% by weight of iron, from 9% to 35% by weight of zinc, up to 0.4% by weight of phosphorus, a maximum of 0.03% by weight silicon, a maximum of 0.05% by weight of manganese and the remainder is copper, as well as inevitable impurities. The grain refined alloy has an average as-cast grain size of less than 100 microns and an average grain size after processing of between about 5 and 20 microns.

In accordance with a second embodiment of the invention, there is provided a thixoformable copper alloy that consists essentially, by weight, of from 70% to 90% copper, from an amount effective to form an as-cast non-dendritic structure up to 3.5% of a grain refiner, from an amount effective to provide a minimum semisolid forming processing range of 20° C. to 3.5% of a melting point depressor, less than 1% of nickel and the balance is zinc and unavoidable impurities.

The above stated objects, features and advantages will become more apparent from the specification and drawings that follow.

IN THE DRAWINGS

FIG. 1 is a flow chart illustrating one method of processing the alloy of the invention.

FIG. 2 graphically illustrates the effect of iron content on the yield strength.

FIG. 3 graphically illustrates the effect of iron content on the ultimate tensile strength.

FIG. 4 graphically illustrates the effect of tin content on the yield strength.

FIG. 5 graphically illustrates the effect of tin content on the ultimate tensile strength.

FIG. 6 graphically illustrates the effect of zinc content on the yield strength.

FIG. 7 graphically illustrates the effect of zinc content on the ultimate tensile strength.

FIG. 8 graphically illustrates the aluminum/copper binary phase diagram.

FIG. 9 graphically illustrates the silicon/copper binary phase diagram.

FIG. 10 graphically illustrates the tin/copper binary phase diagram.

DETAILED DESCRIPTION

Figure 1:
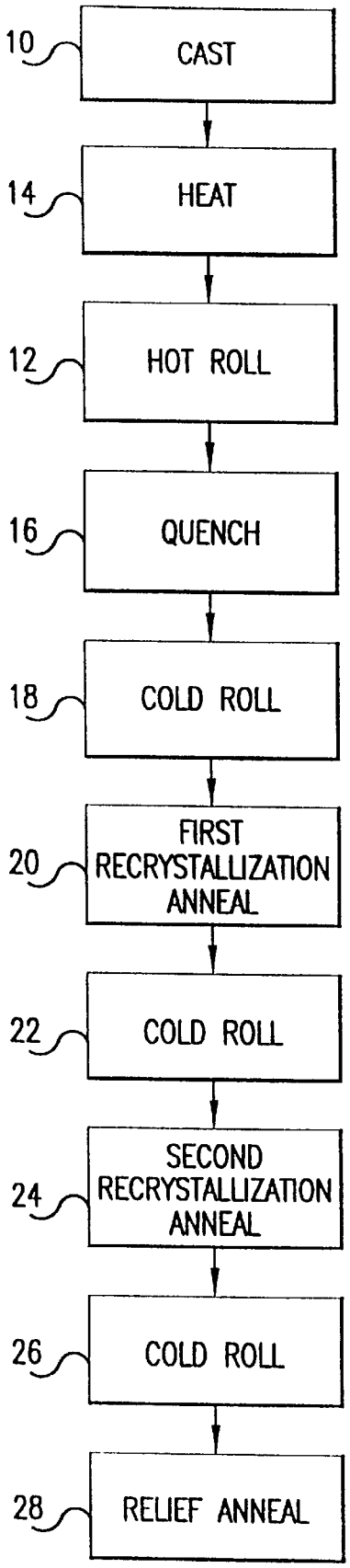

The copper alloys of the invention are an iron modified tin brass. The alloys consist essentially of from 1% to 4% of tin, from 0.8% to 4.0% of iron, from 9% to 20% of zinc, up to 0.4% of phosphorus and the remainder is copper along with inevitable impurities. As cast, the grain refined alloy has an average crystalline grain size of less than 100 microns.

When the alloy is cast by direct chill casting, in preferred embodiments, the tin content is from 1.5% to 2.5% and the iron content is from 1.6% to 2.2%. 1.6% of iron has been found to be a critical minimum to achieve as-cast grain refinement. Most preferably, the iron content is from 1.6% to 1.8%.

Tin

Tin increases the strength of the alloys of the invention and also increases the resistance of the alloys to stress relaxation.

The resistance to stress relaxation is recorded as percent stress remaining after a strip sample is preloaded to 80% of the yield strength in a cantilever mode per ASTM (American Society for Testing and Materials) specifications. The strip is heated to 125° C. for the specified number of hours and retested periodically. The properties were measured at up to 3000 hours at 125° C. The higher the stress remaining, the better the utility of the specified composition for spring applications.

However, the beneficial increases in strength and resistance to stress relaxation are offset by reduced electrical conductivity as shown in Table 1. Further, tin makes the alloys more difficult to process, particularly during hot processing. When the tin content exceeds 2.5%, the cost of processing the alloy may be prohibitive for certain commercial applications. When the tin content is less than 1.5%, the alloy lacks adequate strength and resistance to stress relaxation for spring applications.

TABLE 1

| Composition | Electrical Conductivity (% IACS) | Yield Strength (ksi) |
|---|---|---|
| 88.5% Cu<br>9.5% Zn<br>2% Sn<br>0.2% P | 26 | 75 |
| 87.6% Cu<br>9.5% Zn<br>2.9% Sn<br>0.2% P | 21 | 83 |
| 94.8% Cu<br>5% Sn<br>0.2% P | 17 | 102 |

Preferably, the tin content of the alloys of the invention is from about 1.2% to about 2.2% and most preferably from about 1.4% to about 1.9%.

Iron

Iron refines the microstructure of the as-cast alloy and increases strength. The refined microstructure is characterized by an average grain size of less than 100 microns. Preferably, the average grain size is from 30 to 90 microns and most preferably, from 40 to 70 microns. This refined microstructure facilitates mechanical deformation at elevated temperatures, such as rolling at 850° C.

When the iron content is less than about 1.6%, the grain refining effect is reduced and coarse crystalline grains, with an average grain size on the order of 600–2000 microns, develop. When the iron content exceeds 2.2%, excessive amount of stringers develop during hot and cold working.

The effective iron range, 1.6%–2.2%, differs from the iron range of the alloys disclosed in Caron et al. U.S. Pat. No. 5,882,442. Caron et al. disclose that grain refinement was not optimized until the iron content exceeded about 2%. The ability to refine the grain structure at lower iron contents in the alloys of the present invention was unexpected and believed due to a phase equilibrium shift due to the inclusion of zinc. To be effective, this phase shift interaction requires a minimum zinc content of about 5%.

Large stringers, having a length in excess of about 200 microns, are expected to form when the iron content exceeds about 2.2%. The large stringers impact both the appearance of the alloy surface as well as the properties, electrical and chemical, of the surface. The large stringers can change the solderability and electro-platability of the alloy.

To maximize the grain refinement and strength increase attributable to iron without the detrimental formation of stringers, the iron content should be maintained between about 1.6% and 2.2% and preferably, between about 1.6% and 1.8%.

Zinc

The addition of zinc to the alloys of the invention would be expected to provide a moderate increase in strength with some decrease in electrical conductivity. While, as shown in Table 2, this occurred, surprisingly, with a minimum of 5% zinc present, the grain refining capability of the iron addition as significantly enhanced.

TABLE 2

| Composition | Electrical Conductivity (% IACS) | Tensile Strength (ksi) |
|---|---|---|
| 1.8 Sn<br>2.2 Fe | 33 | 99 |

TABLE 2-continued

| Composition | Electrical Conductivity (% IACS) | Tensile Strength (ksi) |
|---|---|---|
| balance Cu<br>1.8 Sn<br>2.2 Fe<br>5 Zn<br>balance Cu | 29 | 99 |
| 1.8 Sn<br>2.2 Fe<br>10 Zn<br>balance Cu | 25 | 108 |

(Tensile strength measured following 70% cold reduction)

Preferably, the zinc content is from that effective to enhance iron initiated grain refinement to about 20%. More preferably, the zinc content is from about 5% to about 15% and most preferably, the zinc content is from about 9% to about 13%.

Other additions

Phosphorous may be added to the alloy to prevent the formation of copper oxide or tin oxide particles and to promote the formation of iron phosphides. Phosphorous causes problems with the processing of the alloy, particularly with hot rolling. It is believed that the iron addition counters the detrimental impact of phosphorous. At least a minimal amount of iron must be present to counteract the impact of the phosphorous.

A suitable phosphorous content is any amount up to about 0.4% that is effective to form iron phosphides. A preferred phosphorous content is from about 0.01% to 0.3% and a most preferred phosphorous content is from about 0.03% to 0.15%.

Elements that remain in solution when the copper alloy solidifies may be present in amounts of up to 20% and may substitute, at a 1:1 atomic ratio, for a portion of the zinc. The preferred ranges of these solid-state soluble elements are those specified for zinc. One such element is aluminum.

While nickel additions degrade electrical conductivity, nickel improves the resistance of the alloy to stress relaxation. Alloys of the invention containing impurity amounts of nickel have good resistance to stress relaxation at temperatures up to 125° C. An addition of between 0.3% and 1.8%, by weight, of nickel provides the alloy with good stress relaxation resistance up to 150° C. A preferred nickel content is from 0.5% to 1.0%, by weight.

Less preferred are additions of elements that affect the properties of the alloy, such as manganese, magnesium, beryllium, silicon, zirconium, titanium, chromium and mixtures thereof. These less preferred additions are preferably present in an amount of less than about 0.4% each, and most preferably, in an amount of less than about 0.2%. Most preferably, the sum of all less preferred alloying additions is less than about 0.5%.

Silicon additions to the alloy degrade hot workability. Therefore, the 15 alloys of the invention contain less than 0.03% silicon and, preferably, contain less than 0.01% silicon and most preferably contain less than 0.005% of silicon.

Manganese can combine with sulfur impurities to form manganese sulfide stringers. Therefore, the alloys of the invention contain less than 0.9% of manganese, and, preferably, contain less than 0.05% manganese and most preferably contain less than 0.005% of manganese.

Processing

The alloys of the invention are preferably processed according to the flow chart illustrated in FIG. 1. An ingot, being an alloy of a composition specified herein, is cast 10 by a conventional process such direct chill casting. The alloy is hot rolled 12, at a temperature of from about 650° C. to about 950° C. and preferably, at a temperature of between about 825° C. and 875° C. Optionally, the alloy is heated 14 to maintain the desired hot roll 12 temperature.

The hot rolling reduction is, typically, by thickness, up to 98% and preferably, from about 80% to about 95%. The hot rolling may be in a single pass or in multiple passes, provided that the temperature of the ingot is maintained at above 650° C.

After hot rolling 12, the alloy is, optionally, water quenched 16. The bars are then mechanically milled to remove surface oxides and then cold rolled 18 to a reduction of at least 60%, by thickness, from the gauge at completion of the hot roll step 12, in either one or multiple passes. Preferably, the cold roll reduction 18 is from about 60%–90%.

The strip is then annealed 20 at a temperature between about 400° C. and about 600° C. for a time of from about 0.5 hour to about 8 hours to recrystallize the alloy. Preferably, this first recrystallization anneal is at a temperature between about 500° C. and about 600° C. for a time between 3 and 5 hours. These times are for bell annealing in an inert atmosphere such as nitrogen or in a reducing atmosphere such as a mixture of hydrogen and nitrogen.

The strip may also be strip annealed, such as for example, at a temperature of from about 600° C. to about 950° C. for from 0.5 minute to 10 minutes.

The first recrystallization anneal 20 causes additional precipitates of iron and iron phosphide to develop. These precipitates control the grain size during this and subsequent anneals, add strength to the alloy via dispersion hardening and increase electrical conductivity by drawing iron out of solution from the copper matrix.

The bars are then cold rolled 22 a second time to a thickness reduction of from about 30% to about 70% and preferably of from about 35% to about 45%.

The strip is then given a second recrystallization anneal 24, utilizing the same times and temperatures as the first recrystallization anneal. After both the first and second recrystallization anneals, the average grain size is between 3 and 20 microns. Preferably, the average grain size of the processed alloy is from 5 to 10 microns.

The alloys are then cold rolled 26 to final gauge, typically on the order of between 0.010 inch and 0.015 inch. This final cold roll imparts a spring temper comparable to that of copper alloy C51000.

The alloys are then relief annealed 28 to optimize resistance to stress relaxation. One exemplary relief anneal is a bell anneal in an inert atmosphere at a temperature of between about 200° C. and about 300° C. for from 1 to 4 hours. A second exemplary relief anneal is a strip anneal at a temperature of from about 250° C. to about 600° C. for from about 0.5 minutes to about 10 minutes.

Following the relief anneal 28, the copper alloy strip is formed into a desired product such as a spring or an electrical connector.

In accordance with an alternative embodiment of the invention, the alloys of the invention containing between 70% and 90% of copper may be formed into semisolid casting stock. A grain refiner, preferably iron, is added to the alloy. The minimum effective iron content is that which causes the alloy to solidify with an as-cast non-dendritic grain structure. A suitable iron range is between 0.05% and 3.5%. Preferably, the iron content is between about 1.0% and 2.0%.

When the iron content is less than 0.05%, the grain refinement is inadequate and interlocking dendrites form. When the iron content exceeds 3.5%, the number and size of iron particles that may form in the alloy increases. This could lead to plating defects, hard spots in the casting and cosmetic defects.

Cobalt may substitute for either a portion or all of the iron.

Other elements that form precipitates that pin grain boundaries during recrystallization anneals occurring during subsequent processing of semisolid forming feedstock may be added to the alloy. Up to 0.4%, in total, of chromium, titanium, zirconium and mixtures thereof may be present.

Tin is added to the alloy to increase the semisolid forming processing range. An effective minimum tin content is that which provides a minimum semisolid forming processing range of 20° C. and preferably, a minimum semisolid forming processing range of 30° C. A suitable tin content is between 1% and 4%, and preferably between 1% and 2%. When the tin content is less than 1% the semisolid forming processing range is too narrow for commercial operations. When the tin content exceeds 4%, undesirable copper/tin intermetallics form.

Figure 8:
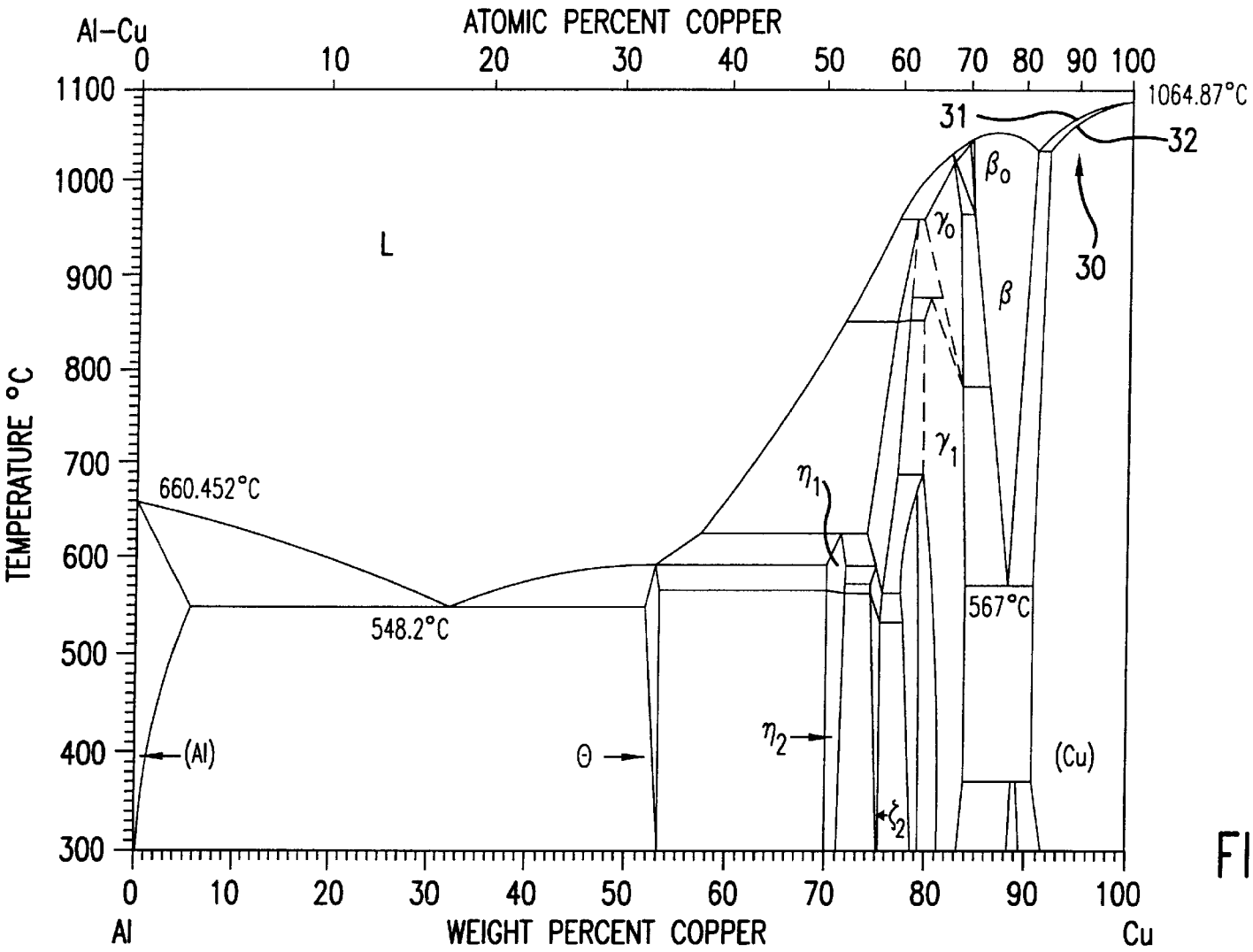
Figure 9:
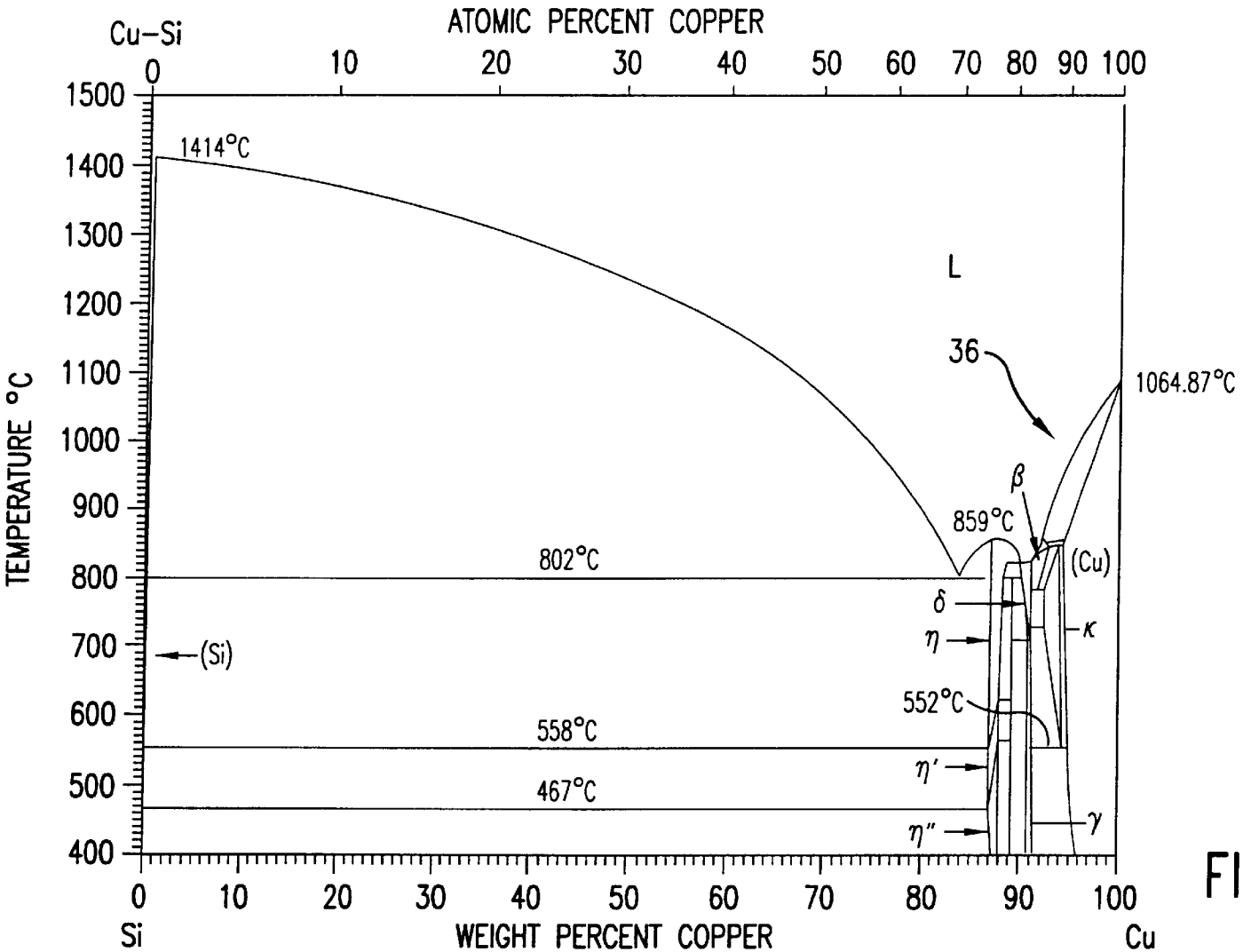
Figure 10:
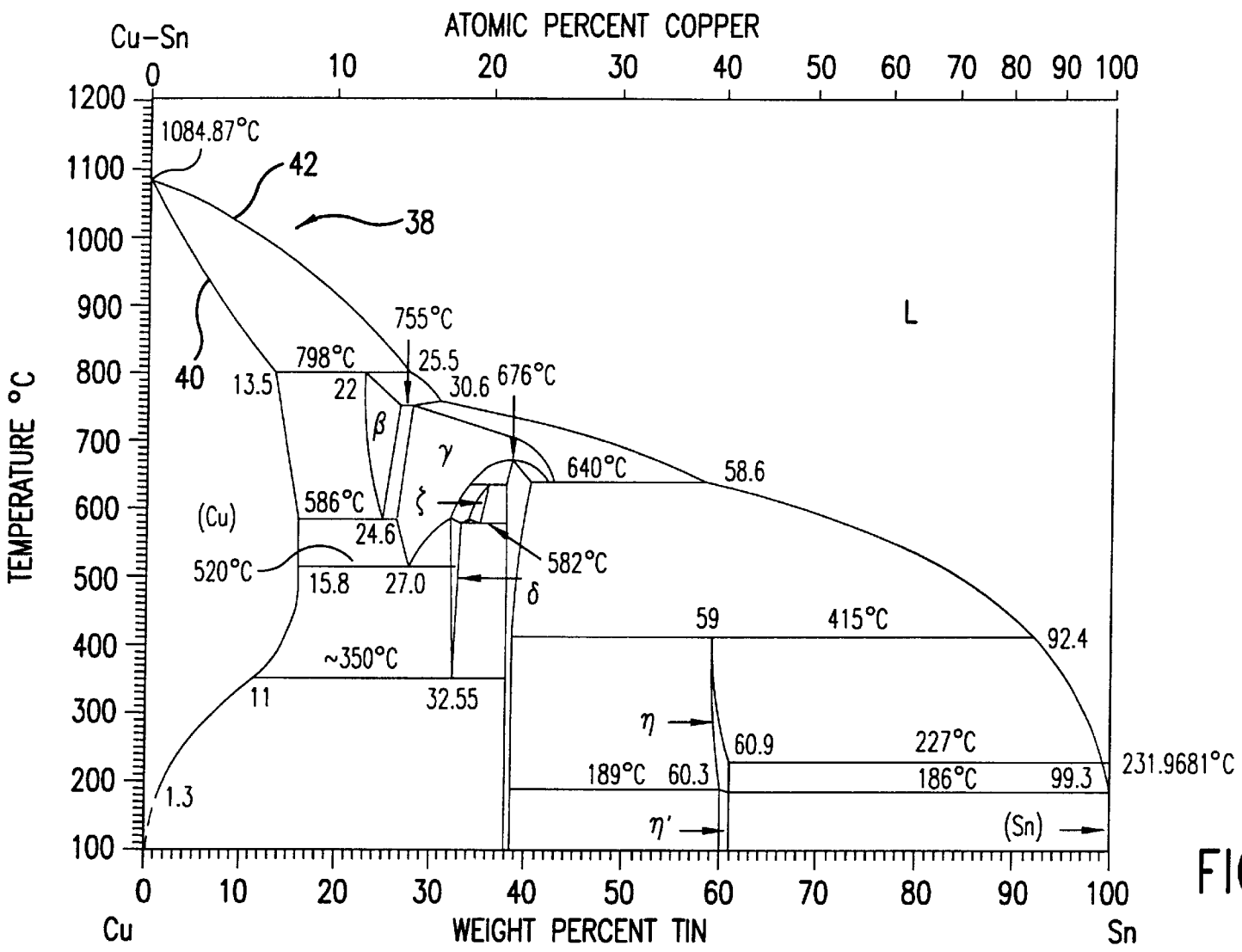

While other additions to a copper alloy also form a segregated lower melting phase, FIGS. 8–10 illustrate the superior effect of tin. FIG. 8 graphically illustrates the binary aluminum-copper phase diagram. In the region identified by reference arrow 30, representing about 1%–4% aluminum, the distance between the liquidus 32 and solidus 34 is small resulting in a narrow semisolid forming processing range.

FIG. 9 illustrates by reference arrow 36 a similar narrow semisolid forming processing range when silicon is added to a copper alloy.

FIG. 10 illustrates by reference arrow 38 a considerably wider range between liquidus line 40 and solidus line 42 resulting in an alloy with a tin addition. This alloy has a broader, and superior from a process control standpoint, semisolid forming processing range.

A preferred alloy is a brass having between 10% and 35% of zinc, and preferably between about 15% and 30% of zinc. Within this range, the alloy has a gold to yellow color and acceptable strength. The semisolid formable alloy is particularly useful for semisolid forming of plumbing fixtures, such as a faucet; builder's hardware, such as door knobs and lock components; and sporting goods, such as golf club components. To retain the gold to yellow color, whitening additions, such as nickel and manganese are preferably avoided. The alloy should have less than 1% of nickel or manganese, and preferably less than 0.5%, in total, of nickel and manganese.

Figure 14:
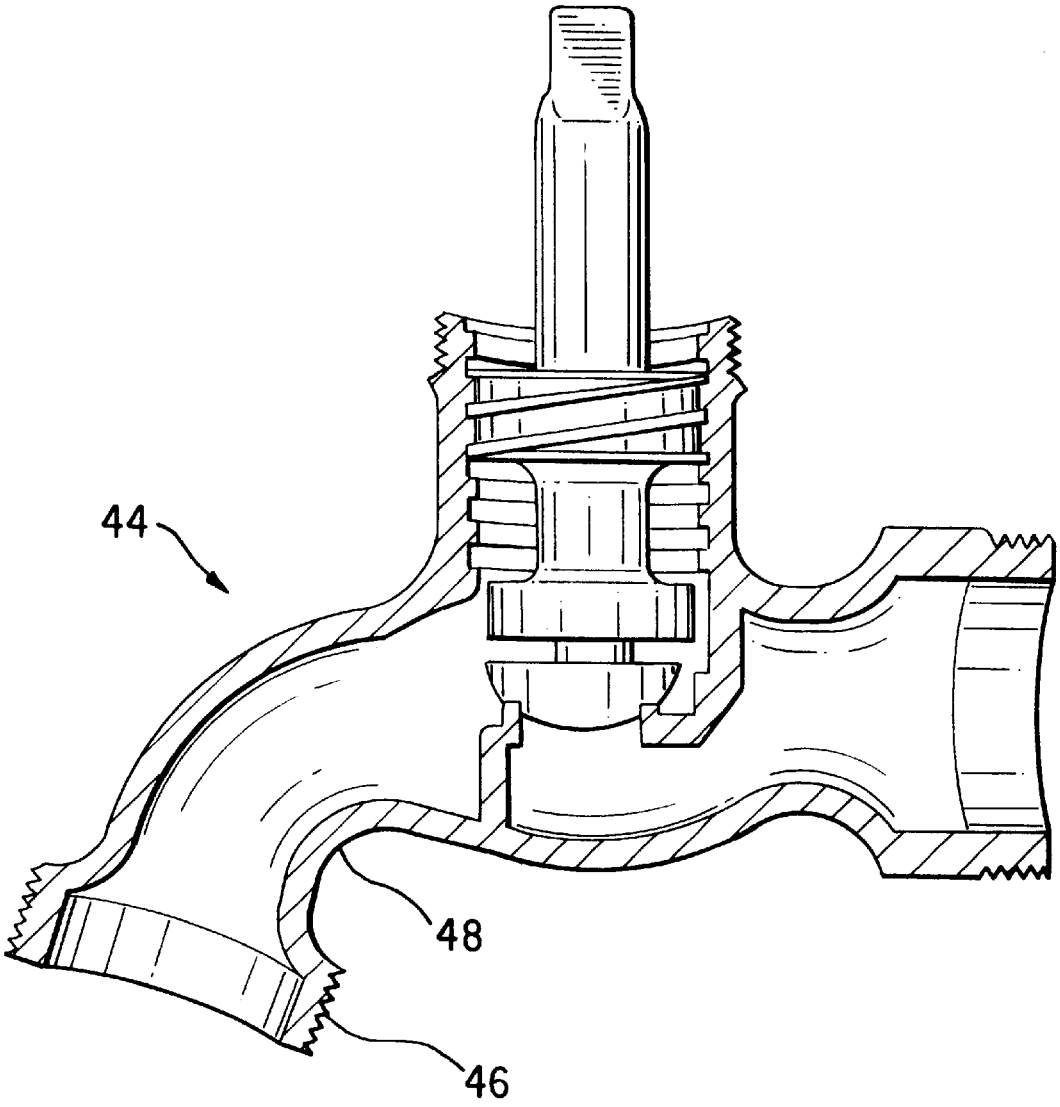
FIG. 14 illustrates a faucet body in cross-sectional representation.

FIG. 14 illustrates in cross-sectional representation a faucet body 44 that is particularly suited to be forged from semisolid forming feedstock. The faucet body includes threads 46 and numerous curved portions 48 requiring an intricately shaped die. Utilization of the lower temperatures of semisolid forming should increase die life. The shear pressures utilized in semisolid forming should insure the metal fills the threads 46 and other aspects of the faucet body.

While particularly drawn to semisolid forming feedstock formed from brass, the specified additions of iron and tin are believed to enhance semisolid forming feedstock from other copper base alloys. Other suitable copper base alloys are believed to include high copper (greater than 85% copper), bronze (copper + up to 10% tin), aluminum bronze (copper + up to 12% aluminum), cupronickels (copper + up to 35% nickel) and nickel silver (copper +up to 25% nickel + up to 40% zinc).

The advantages of the alloys of the invention will become more apparent from the examples that follow.

EXAMPLES

Example 1

Copper alloys containing 10.5% zinc, 1.7% tin, 0.04% phosphorous, between 0% and 2.3% iron and the balance copper were prepared according to the process of FIG. 1. Following the relief anneal 28, the yield strength and the ultimate tensile strength of sample coupons, 2 inch gauge length, were measured at room temperature (20° C.).

The 0.2% offset yield strength and the tensile strength were measured on a tension testing machine (manufactured by Tinius Olsen, Willow Grove, Pa.).

Figure 2:
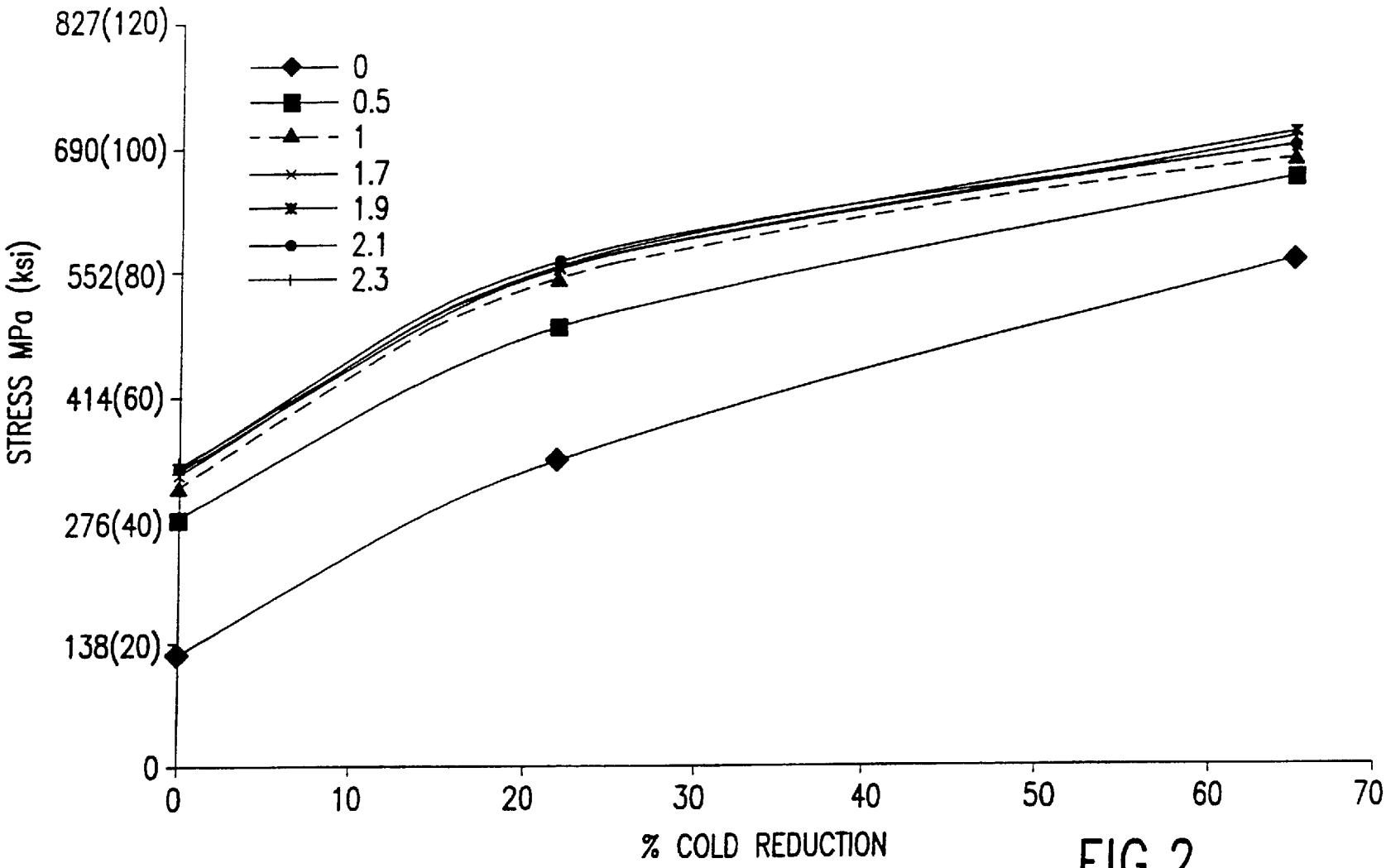

As shown in FIG. 2, increasing the iron from 0% to 1% led to a significant increase in yield strength. Further increases in the iron content had only a minimal effect on strength, but increased the likelihood of stringers.

Figure 3:
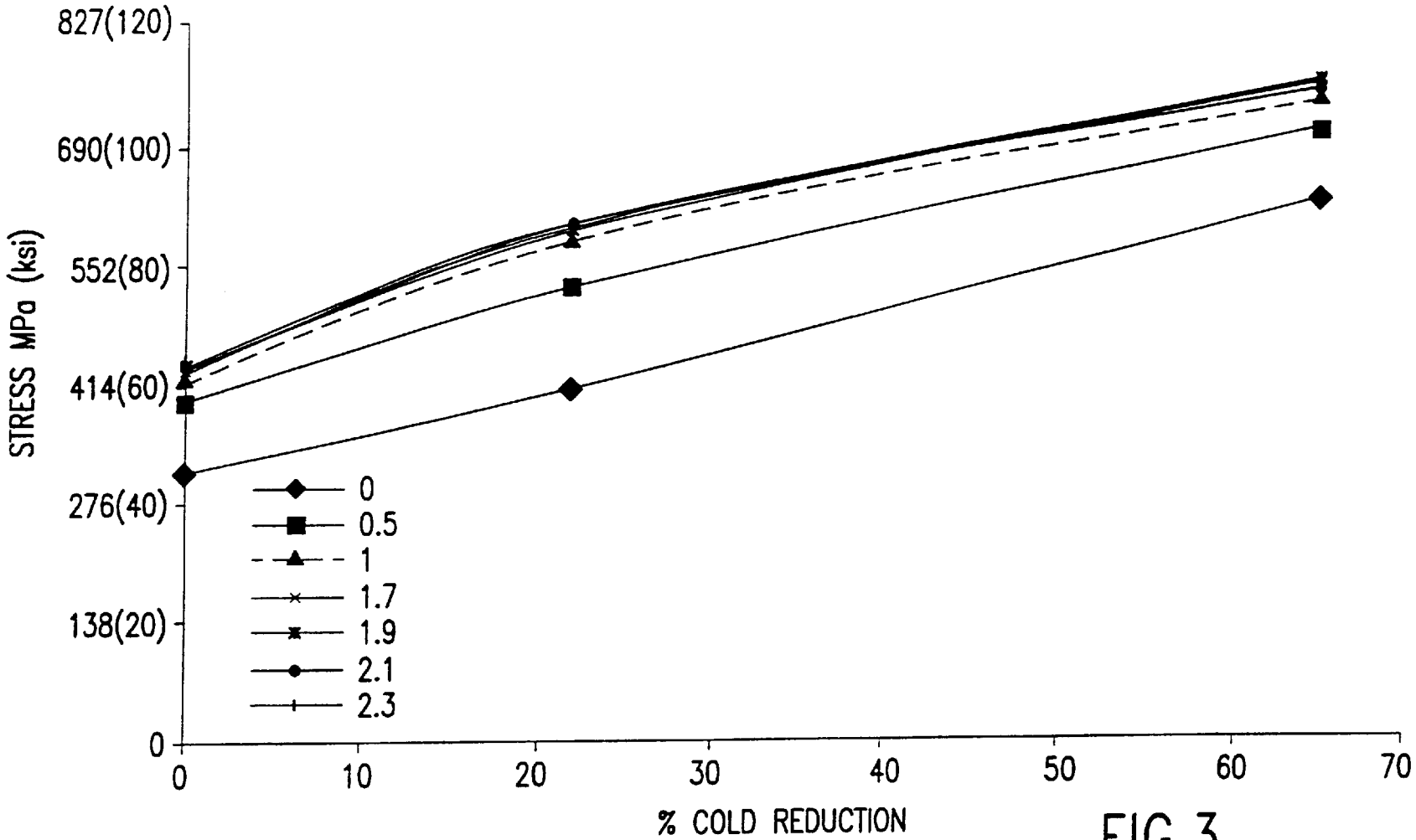

FIG. 3 graphically illustrates a similar relationship between the iron content and the ultimate tensile strength.

Example 2

Copper alloys containing 10.4% zinc, 1.8% iron, 0.04% phosphorous, between 1.8% and 4.0% tin and the balance copper were processed according to FIG. 1. Test coupons in the relief anneal condition 28, were evaluated for yield strength and ultimate tensile strength.

Figure 4:
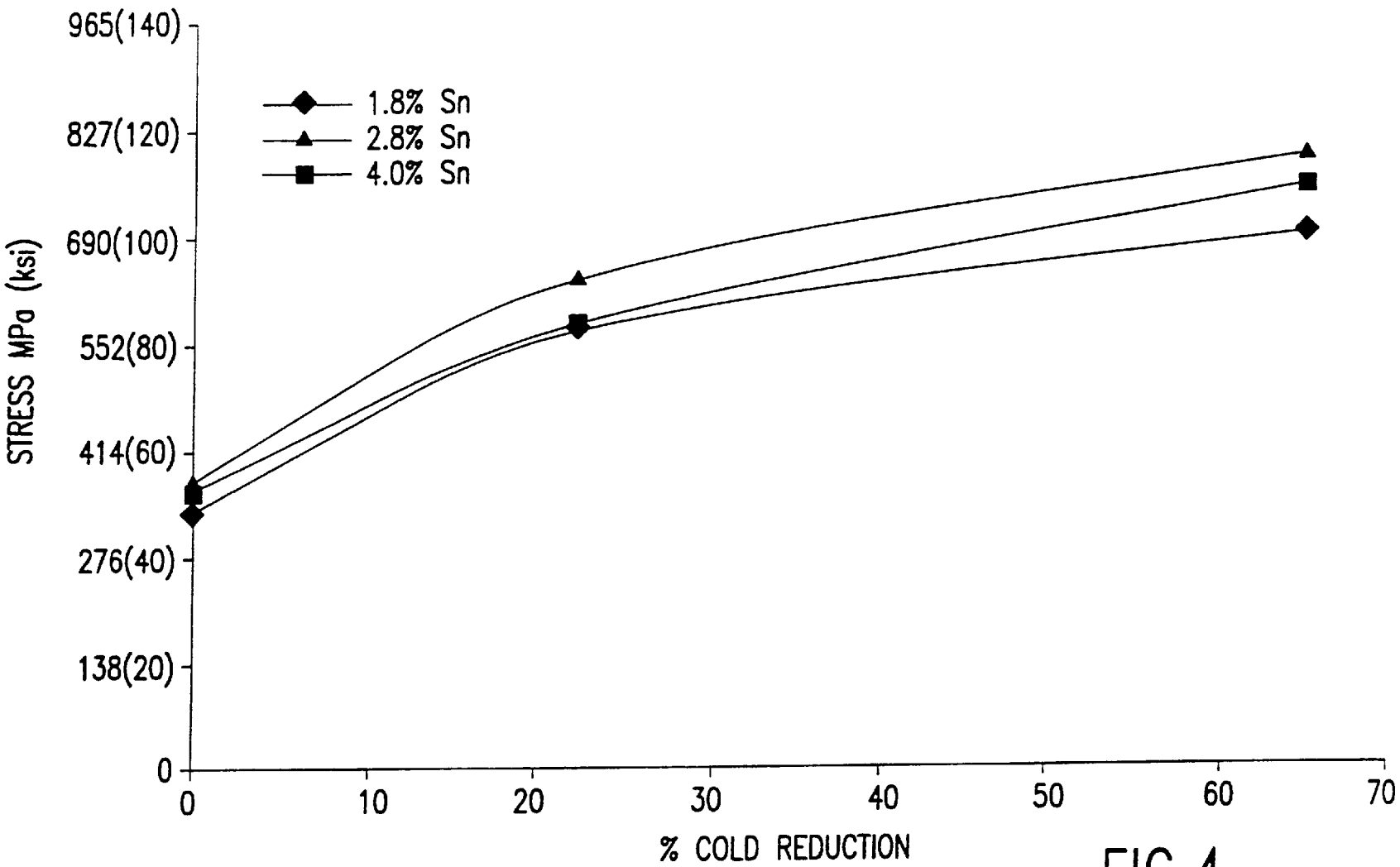
Figure 5:
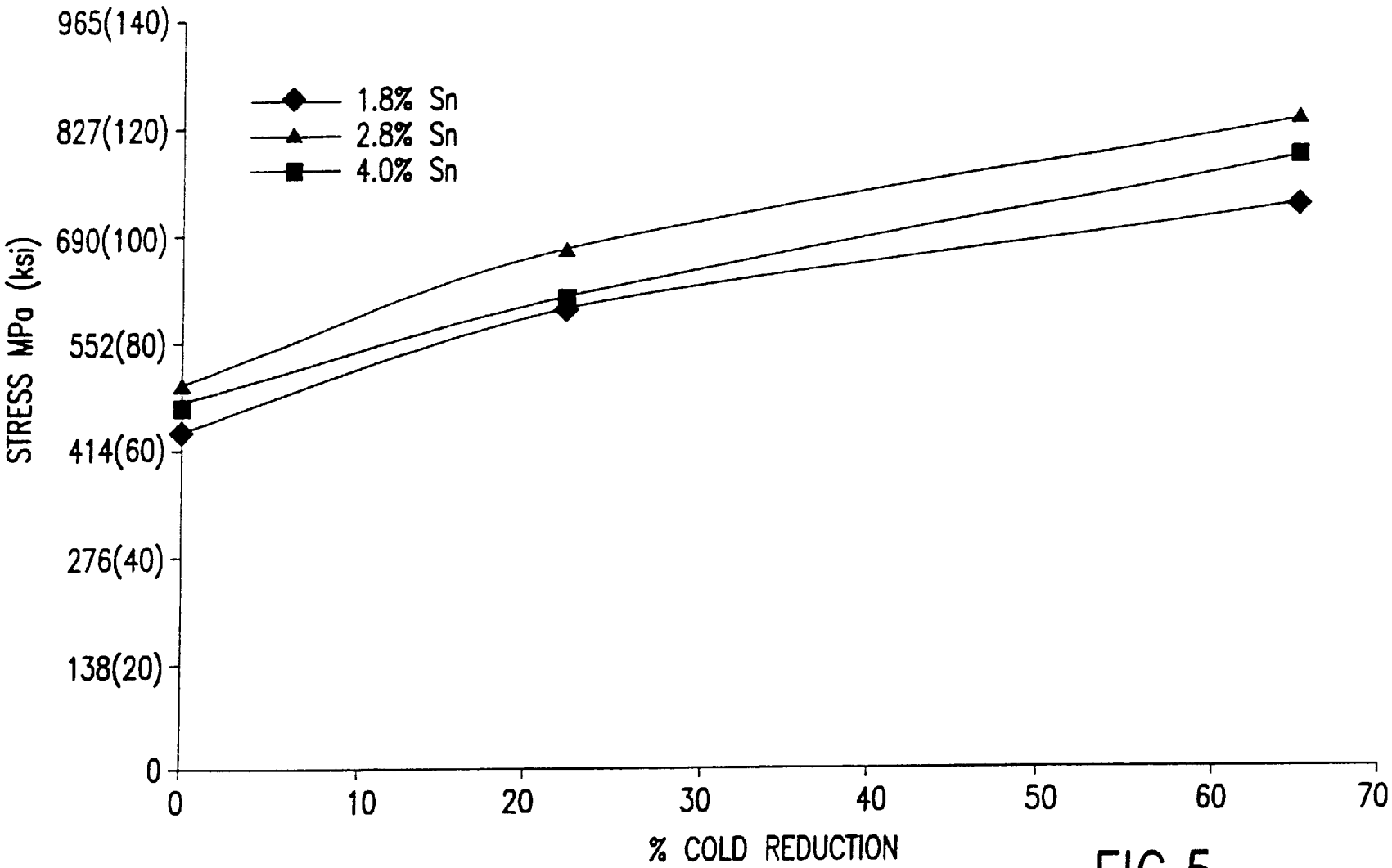

FIG. 4 graphically illustrates that increasing the tin content leads to an increase in yield strength. While FIG. 5 graphically illustrates the same effect from tin additions for the ultimate tensile strength.

Since the strength increase is monatomic with the amount of tin while the conductivity decreases, the tin content should be a trade-off between desired strength and conductivity.

Example 3

Copper alloys containing 1.9% iron, 1.8% tin, 0.04% phosphorous, between 0% and 15% zinc and the balance copper were processed according to FIG. 1. Test coupons in the relief anneal condition 28, were evaluated for yield strength and ultimate tensile strength.

Figure 6:
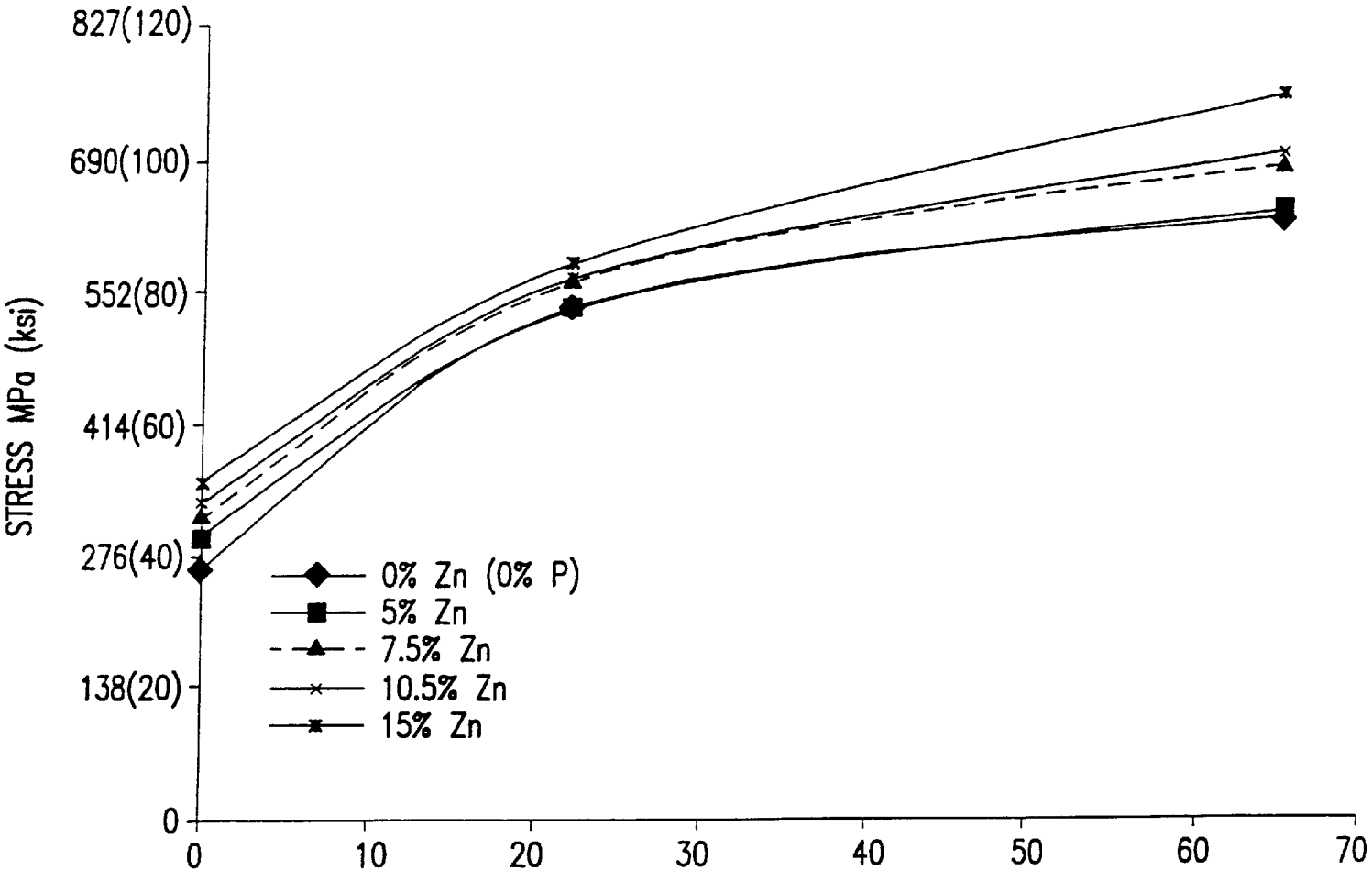

FIG. 6 graphically illustrates that a zinc content of less than about 5% does not contribute to the strength of the alloy, and as discussed above, does not enhance the grain refining capability of the iron. Above 5% zinc, the alloy strength is increased, although a decrease in electrical conductivity is experienced.

Figure 7:
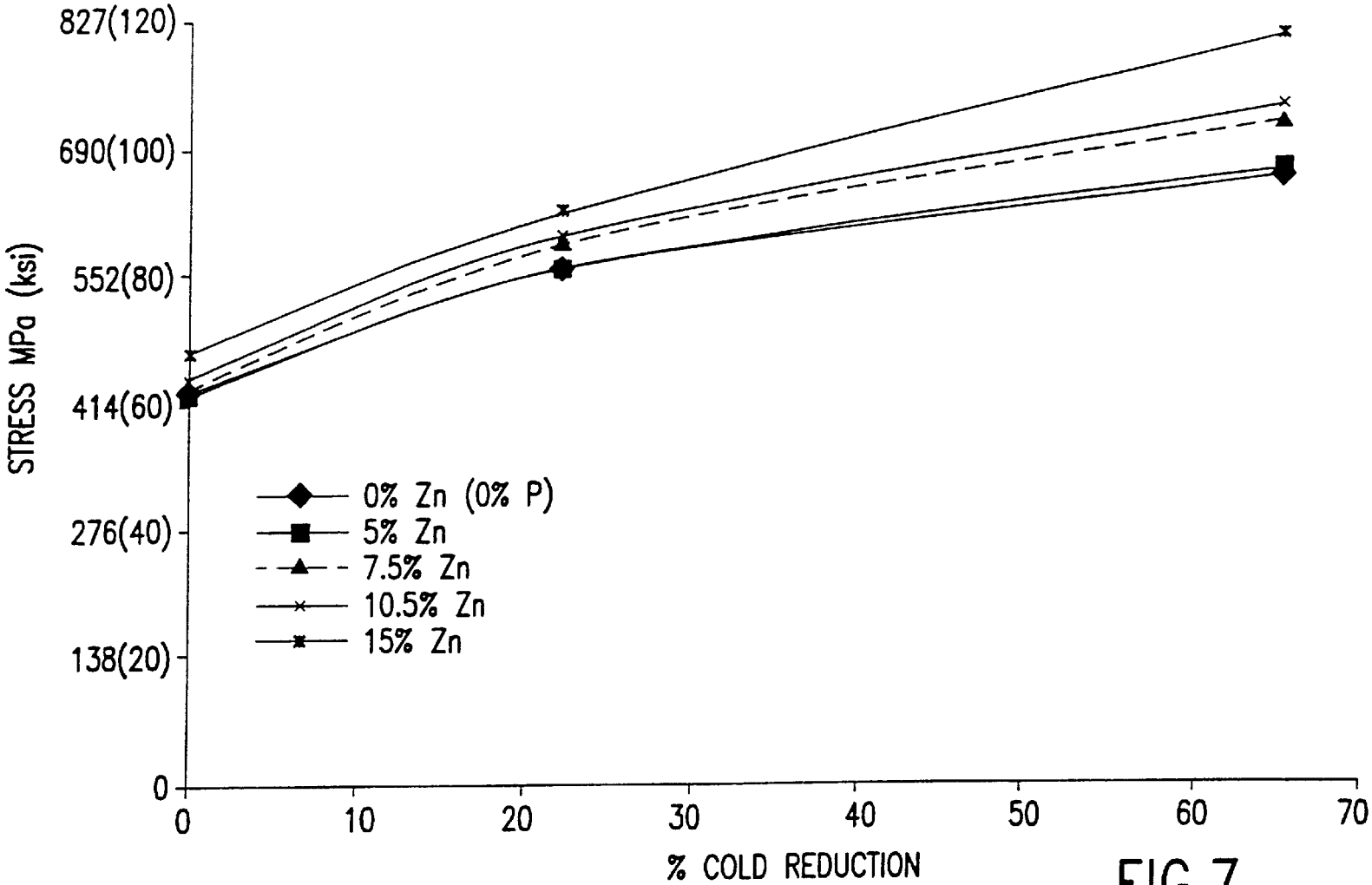

FIG. 7 graphically illustrates the same effect from zinc additions for the ultimate tensile strength of the alloy.

Example 4

Table 3 illustrates a series of alloys processed according to FIG. 1. Alloy A is an alloy of the type disclosed in Caron et al. U.S. Pat. No. 5,882,442. Alloys B and C are in accordance with the present invention and alloy D is conventional copper alloy C510. All properties were measured when the alloy was in a spring temper following a 70% cold roll reduction in thickness.

TABLE 3

| Alloy | Composition | Elec. Conduct. % IACS | Tensile Strength (ksi) | Yield Strength (ksi) |
|---|---|---|---|---|
| A | 1.8 Sn<br>2.2 Fe<br>0.06 P<br>balance Cu | 33% | 99 | 96 |
| B | 1.8 Sn<br>2.2 Fe<br>0.06 P<br>5.0 Zn<br>balance Cu | 29% | 99 | 94 |
| C | 1.8 Sn<br>2.2 Fe<br>0.06 P<br>10.0 Zn<br>balance Cu | 25% | 108 | 101 |
| D | 4.27 Sn<br>0.033 P<br>balance Cu | 17% | 102 | 96 |

Table 3 shows that the addition of 5% zinc did not increase the strength of the alloy and slightly reduced electrical conductivity. A 10% zinc addition had a favorable impact on the strength.

The benefit of the zinc addition is more apparent in view of Table 4 where the strength to rolling reduction is compared.

TABLE 4

| Alloy | % Red. | YS | TS | MBR/t GW | MBR/t BW |
|---|---|---|---|---|---|
| A | 25 | 80 | 83 | 1.0 | 1.3 |
| C | 25 | 84 | 88 | 0.8 | 1.6 |
| A | 33 | 83 | 86 | 1.0 | 1.3 |
| C | 33 | 89 | 94 | 0.9 | 2.1 |
| A | 58 | 96 | 99 | 1.7 | 3.9 |
| C | 60 | 96 | 102 | 1.6 | 6.4 |
| A | 70 | 100 | 104 | 1.9 | 6.3 |
| C | 70 | 101 | 108 | 1.9 | ≧7 |

% Red. = percent reduction in thickness at the final cold working step (reference numeral 26 in FIG. 1).
YS = Yield strength in ksi.
TS = Tensile strength in ksi.
MBR/t (GW) = Good way bends formed around a 180° radius of curvature.
MBR/t (BW) = Bad way bends formed around a 180° radius of curvature.

A further benefit of the zinc addition is the improved good way bends achieved with alloy C. Bend formability was measured by bending a 0.5 inch wide strip 180° about a mandrel having a known radius of curvature. The minimum mandrel about which the strip could be bent without cracking or "orange peeling" is the bend formability value. The "good way" bend is made in the plane of the sheet about an axis in the plane of the sheet and the axis is perpendicular to the longitudinal direction (rolling direction) of the sheet during thickness reduction of the strip. "Bad way" bends are made in the plane of the sheet about an axis parallel to the rolling direction. Bend formability is recorded as MBR/t, the minimum bend radius at which cracking or orange peeling in not apparent, divided by the thickness of the strip.

Usually, an increase in strength is accompanied by a decrease in bend formability. However, with the alloys of the invention, an addition of 10% zinc increases both the strength and the good way bends.

Example 5

Figure 11:
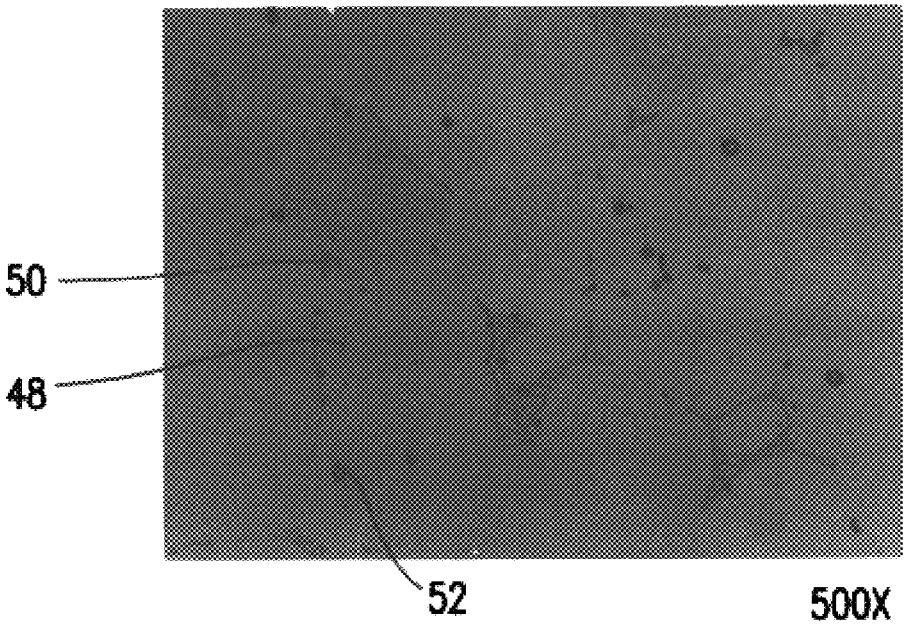
FIG. 11 is a photomicrograph illustrating the as-cast grain structure of a copper-30% zinc-1.5% iron-1.5% tin alloy.

FIG. 11 is a photomicrograph of the as-cast microstructure of a nominal composition Cu-30Zn-1.5Fe-1.5Sn alloy at a magnification of 500×. The grain structure was made visible by etching a polished sample of the alloy for 5–10 seconds at 20° C. in a solution of 20 milliliters ammonium hydroxide, 5 ml 3% hydrogen peroxide and 20 ml water. The grain structure is highly non-dendritic with an average grain size of about 60 μm. Each grain 48 is surrounded by a low melting point phase 50. Properitectic iron dispersoids 52, which are the nucleates for grain refinement, are also apparent. Differential Thermal Analysis data established the freezing range of this alloy to be 860–950° C. The semisolid forming temperature range is approximately 900–920° C.

Figure 12:
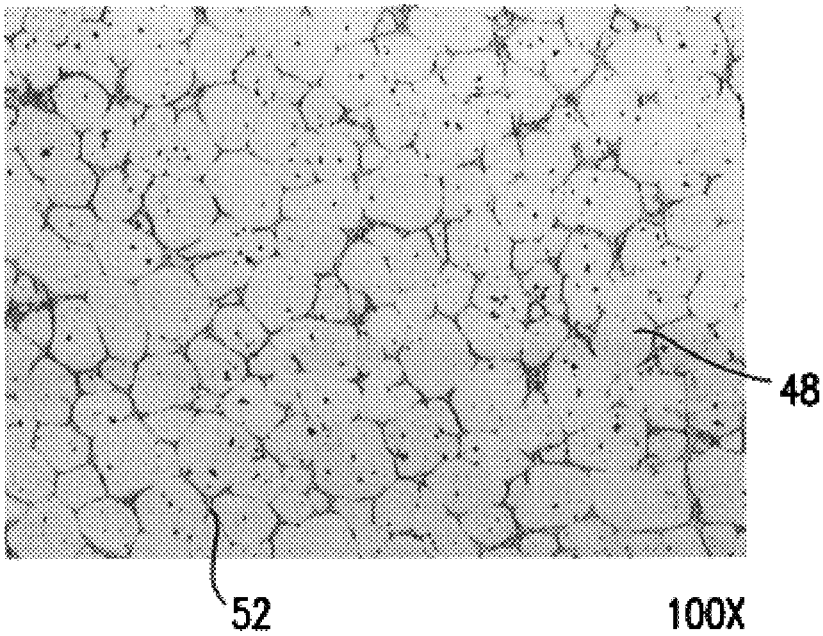
FIG. 12 is a photomicrograph illustrating the grain structure of the alloy of FIG. 11 after thixoforming at 910° C.

FIG. 12 is a photomicrograph of the microstructure of the alloy of FIG. 11 at a magnification of 100×. The alloy is illustrated after semisolid forming at a temperature of 910 C followed by a water quench to preserve the microstructure. At 910° C., the grains 48, measuring approximately 80 μm in diameter, were surrounded by sufficient liquid to permit the material to flow homogeneously under very small applied shears. After forming, this alloy may be homogenized, except for the very small iron phases 52 that are retained in the microstructure, by heat treating at 550° C./4 hrs. The yellow color of this alloy is virtually indistinguishable from alloy C260.

Preferred compositions may be selected to enhance color matching the standard base alloy and to allow post forming heat treatment to match tensile/conductivity targets and/or provide a buff or plating quality surface.

Figure 13:
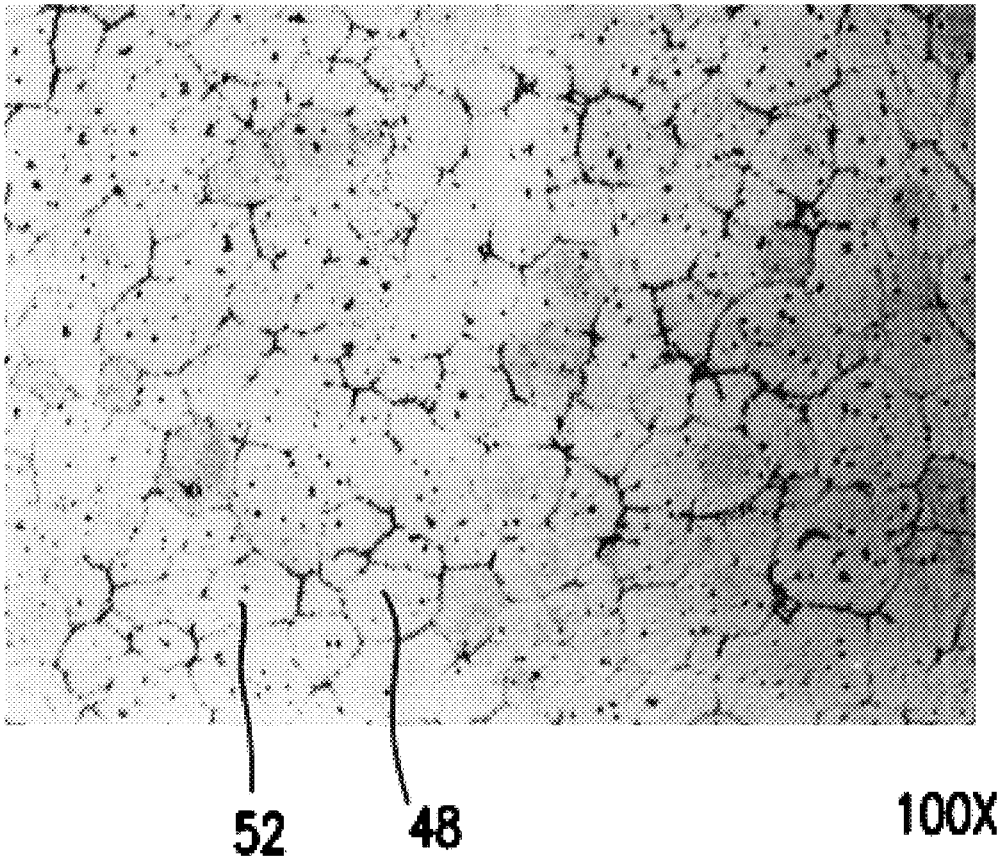
FIG. 13 is a photomicrograph illustrating the grain structure of a copper-15% zinc-2.0% iron-2.0% zinc alloy after thixoforming at 995°.

FIG. 13 is a photomicrograph of the microstructure of nominal composition Cu-15Zn-2.0Fe-2.0Sn at a magnification of 100×. The alloy is illustrated after thixoforming at 995° C. and water quenching. The grains 48 (approximately 80 μm) and iron dispersiod 52 are visible and though the volume fraction of liquid was less than exhibited in FIG. 12, this alloy flowed quite homogeneously under a very small applied shear stress. The color of this alloy was gold rather than yellow and similar in color to alloy C230 (nominal composition of 85% copper and 15% zinc).

While described particularly in terms of direct chill casting, the alloys of the invention may be cast by other processes as well. Some of the alternative processes have higher cooling rates such as spray casting and strip casting. The higher cooling rates reduce the size of the properitectic iron particles and are believed to shift the critical maximum iron content to a higher value such as 4%.

It is apparent that there has been provided in accordance with the invention an iron modified phosphor bronze that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A wrought copper alloy, consisting of:

from 1% to 4% by weight of tin;

from 1.6% to 4.0% by weight of iron;

from 9% to 35% by weight of zinc;

up to 0.4% by weight of phosphorous;

a maximum of 0.03% by weight of silicon;

a maximum of 0.95 by weight of manganese;

up to 20% of aluminum, up to 1.8% of nickel, up to 0.4% each of magnesium, beryllium, zirconium, titanium and chromium, and the remainder copper and inevitable impurities, said alloy having a refined as-cast average crystalline grain size of less than 100 microns.

2. The copper alloy of claim 1 wherein said zinc is present in an amount of from 9% to 13% by weight.

3. The copper alloy of claim 2 further including from 0.3% to 1.8%, by weight, of nickel.

4. The copper alloy of claim 3 wherein a portion of said zinc is replaced at a 1:1 atomic ratio with aluminum.

5. The copper alloy of claim 2 wherein the iron content is from 1.6% to 2.2%.

6. The copper alloy of claim 5 wherein said iron content is from 1.6% to 1.8% by weight.

7. The copper alloy of claim 5 wherein a portion of said zinc is replaced at a 1:1 atomic ratio with aluminum.

8. The copper alloy of claim 6 wherein said tin content is from 1.2% to 2.2%.

9. The copper alloy of claim 8 wherein said phosphorous content is from 0.03% to 0.3%.

10. The copper alloy of claim 5 wherein the maximum silicon content is 0.005% by weight and the maximum manganese content is 0.05% by weight.

11. The copper alloy of claim 8 being wrought to a thickness of from 0.005 inch to 0.015 inch and having an average final gauge grain size of from 3 microns to 20 microns.

12. An electrical connector formed from the alloy of claim 8.

13. A spring formed from the alloy of claim 11.

14. The copper alloy of claim 5 wherein the maximum silicon content is 0.01% by weight and the maximum manganese content is 0.005% by weight.

15. The copper alloy of claim 14 wherein the maximum silicon content is 0.005% by weight.

16. A copper alloy for semisolid forming feedstock consisting of;

from 65% to 90% by weight, of copper;

from 1% up to 3.5% of iron, Co or mixture thereof as a grain refiner;

from an amount effective to provide a minimum thixoforging processing range of 20° C. up to 3.5%, by weight, of tin as a melting point depresser;

less than 1% by weight, of nickel;

up to 20% of aluminum and less than 0.4% each of manganese, magnesium, beryllium, silicon, zirconium, titanium and chromium; and the balance zinc and unavoidable impurities.

17. The copper alloy of claim 16 wherein said iron is present in an amount of from 1.0% to 2.0%.

18. The copper alloy of claim 17 wherein said tin is present in an amount of from 1% to 2%.

19. A plumbing fixture formed from the copper alloy of claim 18.

20. The copper alloy of claim 16 wherein said tin is present in an amount of from 1% to 2%.

21. A plumbing fixture formed from the copper alloy of claim 20.

* * * * *